US007270293B1

(12) United States Patent
Karoly

(10) Patent No.: US 7,270,293 B1
(45) Date of Patent: Sep. 18, 2007

(54) SPINDLE SUPPORT BRACKET

(76) Inventor: John Karoly, 2610 24th Ave., St. Petersburg, FL (US) 33713

( * ) Notice: Subject to any disclaimer, the term of this patent is extended or adjusted under 35 U.S.C. 154(b) by 0 days.

(21) Appl. No.: 11/385,981

(22) Filed: Mar. 21, 2006

Related U.S. Application Data

(60) Provisional application No. 60/664,583, filed on Mar. 23, 2005.

(51) Int. Cl.
*B65H 75/18* (2006.01)

(52) U.S. Cl. ..... 242/598.3; 242/598.5; 248/163.2

(58) Field of Classification Search ..... 242/598, 242/598.3, 598.5, 599.3, 588, 588.6, 398, 242/401; 248/163.2, 164, 170, 440.1, 81, 248/83
See application file for complete search history.

(56) References Cited

U.S. PATENT DOCUMENTS

| | | | | | |
|---|---|---|---|---|---|
| 442,309 | A | | 12/1890 | Diamond et al. | |
| 875,476 | A | | 12/1907 | Wasson | |
| 1,479,209 | A | | 1/1924 | Topp | |
| 1,509,717 | A | | 9/1924 | Davis | |
| 1,660,521 | A | | 2/1928 | Norgren | |
| 2,085,636 | A | * | 6/1937 | Collins | 242/598 |
| 2,155,769 | A | | 4/1939 | Porter | |
| 2,551,190 | A | | 5/1951 | Walker | |
| 2,705,114 | A | | 3/1955 | Worsham | |
| 2,957,644 | A | | 10/1960 | Beardslee | |
| 3,212,465 | A | | 10/1965 | Cates, Jr. et al. | |
| 3,383,071 | A | | 5/1968 | Godson | |
| 3,559,914 | A | * | 2/1971 | Alderman | 242/598 |
| 3,610,431 | A | | 10/1971 | Rodden | |
| 3,759,538 | A | | 9/1973 | Fabiano | |
| 3,870,177 | A | | 3/1975 | Cobb | |
| 3,990,653 | A | | 11/1976 | Marcell | |
| 4,006,865 | A | | 2/1977 | Howard | |
| 4,078,355 | A | * | 3/1978 | Clemensen | 242/598.5 |
| 4,179,080 | A | | 12/1979 | Patnaude | |
| 4,222,212 | A | * | 9/1980 | Alderman | 242/598.5 |
| 4,391,422 | A | | 7/1983 | McDonald | |
| 4,457,527 | A | | 7/1984 | Lowery | |
| 4,496,028 | A | | 1/1985 | Peterson | |
| 4,530,472 | A | | 7/1985 | Voss et al. | |
| 4,553,091 | A | | 11/1985 | Knight | |
| 4,564,152 | A | | 1/1986 | Herriage | |
| D286,493 | S | * | 11/1986 | Floyd | 242/598.5 |
| 4,706,906 | A | | 11/1987 | Roman et al. | |
| 4,752,047 | A | | 6/1988 | Franks, Jr. | |
| 4,932,601 | A | | 6/1990 | Arrington | |
| 5,096,072 | A | | 3/1992 | Link | |

(Continued)

FOREIGN PATENT DOCUMENTS

| | | |
|---|---|---|
| GB | 827.826 | 2/1960 |

(Continued)

*Primary Examiner*—William A. Rivera
(74) *Attorney, Agent, or Firm*—Michael I Kroll

(57) ABSTRACT

The present invention is a stand used for supporting a reel of wound material typically wire, by means of a spindle extending through a reel that is supported at either end by spindle support members having a triangular form and with at least one angled receiving aperture made through a corner having a collar, whereby when assembled produces a horizontally disposed spindle supported by opposing inwardly angled triangular support members where said spindle ends are supported about said support members apexes.

16 Claims, 9 Drawing Sheets

U.S. PATENT DOCUMENTS

| | | | | |
|---|---|---|---|---|
| 5,285,981 | A | 2/1994 | Pavelka | |
| 5,316,232 | A | 5/1994 | Lambert, Jr. | |
| 5,452,872 | A | 9/1995 | Barnes et al. | |
| 5,692,701 | A | 12/1997 | Holliday | |
| 5,732,899 | A | 3/1998 | Edgar | |
| 5,806,787 | A | 9/1998 | Schneider | |
| 6,076,780 | A | 6/2000 | Honnecke et al. | |
| 6,086,013 | A | 7/2000 | Looney et al. | |
| 6,199,786 | B1 | 3/2001 | Lessard et al. | |
| 6,299,100 | B1 | 10/2001 | Cloud | |
| 7,077,368 | B1 * | 7/2006 | Karoly | 248/163.2 |

FOREIGN PATENT DOCUMENTS

| | | |
|---|---|---|
| GB | 966.726 | 8/1964 |

* cited by examiner

SPINDLE SUPPORT BRACKET

RELATED APPLICATIONS

This application is subject to U.S. provisional application Ser. No. 60/664,583; filed 23 Mar. 2005. Please incorporate by reference all information in said provisional application into this instant application.

BACKGROUND OF THE INVENTION

1. Field of the Invention

The present invention relates generally to the supporting of a spindle that reels or spools are placed on for dispensing of materials that are purchased on a reel or spool (i.e. wire, tubing, rope string etc.) And more specifically to a very portable bracket that would be generally used in field applications that require the above mentioned spindle to be frequently and/or readily moved to accommodate the dispensing of materials in various, space limited and many locations, in which a permanent or fixed support would not be available or feasible.

Various holders have been designed for spools, in order to make access, handling, and unwinding of wire easier. Marcell (U.S. Pat. No. 3,990,653, issued Nov. 9, 1976) discloses a wheeled cart with turnable-style supporting bases upon which coils of wire are laid. Marcell includes a tray and tool box supports. Howard (U.S. Pat. No. 4,006,865, issued Feb. 8, 1977) discloses a system with dispensing reels for use with box wire. McDonald (U.S. Pat. No. 4,391,422, issued Jul. 5, 1983) discloses a spool carrier having a rectangular main frame and a wheel system depending from a mid-portion of the main frame for wheeling the main frame around. Knight (U.S. Pat. No. 4,553,091, issued August 1985) discloses brackets, which hold spool-carrying bars, for mounting on the support legs of a freestanding ladder. The Knight brackets have pivoting cylinders which receive the bar ends and allow the bars to pivot out away from one of the ladder legs for addition or removal of spools. Link (U.S. Pat. No. 5,096,072, issued Mar. 17, 1992 discloses a fold-out carrying device shaped generally like a step stool with baskets in place of the steps for carrying items. Pavelka (U.S. Pat. No. 5,285,981, issued Feb. 15, 1994) discloses a wire dispenser with a rectangular frame perpendicular to a wheel spindle, and spool bars extending horizontally out from both sides of the rectangular frame. Lambert, Jr. (U.S. Pat. No. 5,316,232, issued May 31, 1994) discloses a horizontal, table-shaped wire dispenser frame with spool-holders inside the frame. Edgar (U.S. Pat. No. 5,732,899, issued Mar. 31, 1998) discloses a selectively rotatable wire reel unwinding assembly, which has a plurality of spool-holding branches extending out at various levels from a vertical post. Beardslee (U.S. Pat. No. 2,957,644) discloses a dispenser reel rack having two sides connected by an ear and cotter pin system. To connect the cross bars to the rack, Beardslee uses spring-biased pivoting sleeves that surrounds a leg of one on the sides.

The above mentioned prior arts are solutions to a means to support reels and/or spools for dispensing of wire or material that is purchased wound upon said spool or reel. The prior arts include spindles as integral parts of the inventions, for the reason, the spindle(s) have to have a means in which a clip, pin or other devices are inserted or attached to said spindle, to limit lateral movement or rotation of said spindle(s), or to keep the spools and/or reels from detaching, becoming uneven or in some manner restricting free rotation of the spools and/or reels, also not to interfere with the material being dispensed. Therefore requiring the above mentioned spindle(s) to be cut to a fixed length(s), holes bored in exact locations to accept fasteners, etc. and further more then the fasteners themselves are another piece(s) that are necessary to have in order to make the inventions work properly, in which most cases are lost or misplaced while changing said reels or spools. The said spindle(s) being an integral part of the prior arts also make them very cumbersome and awkward to transport and store, are rarely used and are rather costly.

Most brackets are made in the field by the user with anything that will work to support a spindle. Items that are generally used as spindle support, (i.e.) A step ladder, concrete blocks, milk crates, a wall, a person holding said spindle, wooden pallets, 2×4's scaffolding, etc. An imagination is the only limits to a makeshift spindle support, which are generally very unsafe and inefficient. Also they cause much damage to property, injuries to persons and workers comp. insurance to skyrocket.

So I feel very strongly that there is a need for a new bracket that does not include the spindle(s) that the spools and/or reels are placed upon, due to the fact that the spindle(s), in field applications is generally (but not limited to) a scrap or new piece of rigid tubing, conduit, concrete reinforcement bar or any round, rigid material (hollow or solid) that can be inserted through the factory bore provided by the spool or reel manufacturer, in which such spindles are readily available and very safe if applied to a proper support bracket, in the field. Therefore, I disclose this new invention that in fact provides support for a spindle that reels and/or spools are placed upon and is by far much more portable, safe, easy to manufacture, and very inexpensive.

2. Description of the Prior Art

There are other support devices designed for spools or reels. Typical of these is U.S. Pat. No. 442,309 issued to Diamond et al. on Dec. 9, 1890.

Another patent was issued to Wasson on Dec. 31, 1907 as U.S. Pat. No. 875,476. Yet another U.S. Pat. No. 1,479,209 was issued to Topp on Jan. 1, 1924 and still yet another was issued on Sep. 23, 1924 to Davis as U.S. Pat. No. 1,509,717.

Another patent was issued to Norgren on Feb. 28, 1928 as U.S. Pat. No. 1,660,521. Yet another U.S. Pat. No. 2,155,769 was issued to Porter on Apr. 25, 1939. Another was issued to Worsham on Mar. 29, 1955 as U.S. Pat. No. 2,705,114 and still yet another was issued on Oct. 19, 1965 to Cates, Jr. et al. as U.S. Pat. No. 3,212,465.

Another patent was issued to Godson on May 14, 1968 as U.S. Pat. No. 3,383,071. Yet another U.S. Pat. No. 3,610,431 was issued to Rodden on Oct. 5, 1971 Another was issued to Fabiano on Sep. 18, 1973 as U.S. Pat. No. 3,759,538 and still yet another was issued on Mar. 11, 1975 to Cobb as U.S. Pat. No. 3,870,177.

Another patent was issued to Patnaude on Dec. 18, 1979 as U.S. Pat. No. 4,179,080. Yet another U.S. Pat. No. 4,391,422 was issued to McDonald on Jul. 5, 1983. Another was issued to Lowery on Jul. 3, 1984 as U.S. Pat. No. 4,457,527 and still yet another was issued on Jan. 29, 1985 to Peterson as U.S. Pat. No. 4,496,028.

Another patent was issued to Vass, et al. on Jul. 23, 1985 as U.S. Pat. No. 4,530,472. Another was issued to Herriage as U.S. Pat. No. 4,564,152 on Jan. 14, 1986. Yet another U.S. Pat. No. 4,752,047 was issued to Franks, Jr. on Jun. 21, 1988. Another was issued to Arrington on Jun. 12, 1990 as U.S. Pat. No. 4,932,601 and still yet another was issued on Dec. 2, 1997 to Holliday as U.S. Pat. No. 5,692,701.

Another patent was issued to Honnecke et al. on Jun. 20, 2000 as U.S. Pat. No. 6,076,780. Yet another U.S. Pat. No.

6,299,100 was issued to Cloud on Oct. 9, 2001. Another was issued to Standard Telefon Og Kabel-Fabric on Feb. 10, 1960 as United Kingdom No. GB827,826 and still yet another was issued on Aug. 12, 1964 to Clarke as United Kingdom Patent No. GB966,726.

U.S. Pat. No. 442,309

Inventor: George W. Diamond et al.

Issued: Dec. 9, 1890

In a reel, the combination of a supporting-shaft, supports upon the shaft relatively adjustable along the latter, bars D at intervals about the shaft, toggles r r', connecting the bars D toward opposite ends, respectively, with the respective supports, means, substantially as described, for adjusting the supports with relation to each other to cause the bars D to approach or recede from the shaft, and retaining devices E E' toward opposite ends of the shaft, one of which is removable, substantially as set forth.

U.S. Pat. No. 875,476

Inventor: Byron F. Wasson

Issued: Dec. 31, 1907

A wire reel carrier, comprising an approximately U-shaped member composed of a single piece of material and having the free ends of its legs bent at an angle thereto, a tie rod connecting said legs near their bent portion, a cross bar connecting said legs near their inner ends, an upwardly projecting reel carrying pivot bolt rigidly mounted on said cross bar, V-shaped braces secured at their free ends to said legs at opposite sides of said cross bar, an axle pivotally connected with said V-shaped braces, and wheels mounted at opposite ends of said axle.

U.S. Pat. No. 1,479,209

Inventor: Maurice J. Topp

Issued: Jan. 1, 1924

A collapsible horse comprising a channel bar and pivotal pins extending across the channel and secured to the opposite sides thereof, and separate pairs of legs pivotally hung upon said pins and slidable lengthwise thereof to swing into and out of the channel, the legs of each pair being pivoted to each other to swing transversely of the channel.

U.S. Pat. No. 1,509,717

Inventor: Charles C. Davis

Issued: Sep. 23, 1924

In a device of the character described, the combination with a frame having parallel side bars and one end cross bar, of a supporting bar removably carried by the side bars intermediate their ends and adapted to form a rotatable axis for a reel, and a combined draw bar and handle swingingly connected centrally of said cross bar and adapted when in one position to serve as a prop for said frame when standing upon a foundation and when in another position constituting a draft device, and when in still another position to be substantially parallel with and in folded relation to the said side bars.

U.S. Pat. No. 1,660,521

Inventor: Algot W. Norgren

Issued: Feb. 28, 1928

A take-up device for current-carrying cables, comprising a current carrier take-up drum on which the cable is wound and to which the cable is electrically connected, the drum having a contact member forming a necessary structural part of it; and a cooperating contact member disposed axially of the drum and adapted-to carry current and movable toward and from the drum in a direction parallel to the axis thereof through the rotation of the drum to electrically engage and disengage the said contact member which forms a necessary structural part of the drum.

U.S. Pat. No. 2,155,769

Inventor: Howard C. Porter

Issued: Apr. 25, 1939

A strap reel comprising a stand composed of three tubular sections forming two legs and a handle, a pair of brackets clamping the three tubular members rigidly together, and a hook on each bracket for receiving the opposite ends of a drum axle; and a drum for holding a coil of strap, said drum having an axle projecting beyond opposite sides thereof to be received and carried by the bracket hooks.

U.S. Pat. No. 2,705,114

Inventor: Elmer L. Worsham

Issued: Mar. 29, 1955

In a reel supporting device, the combination comprising: frame structure including a pair of side frame assemblies in spaced and parallel-relationship and plurality of cross members holding said side frame assemblies in said position with respect to each other; wheeled means at one corner of each of said side frame assemblies and handles at the other corner of each of said side frame assemblies; a plurality of bearing support members located intermediate said side frame assemblies and mounted on one of said cross members and positioned parallel with each other and with said side frame assemblies; a plurality of co-axial, axially split, bearings comprising upper and lower halves, the lower halves of said bearings being supported respectively on said bearing support members; a plurality of shafts, said shafts being of such length as to extend between each pair of adjacent bearings, and the end of each shaft extending into its corresponding bearing less than half the axial width thereof; manually operable means normally holding the upper halves of said bearings in closed position; whereby each of said reels may be removed from said device upon operation of said last named means without disturbing the supporting means for any of said other reels.

U.S. Pat. No. 3,212,465

Inventor: Henry J. Cates, Jr., et al.

Issued: Oct. 19, 1965

In a drive means for drying grate structure to be employed in an incinerator plant wherein refuse is being delivered continuously from an input onto said drying grates, a drying grate structure including an elongated drying grate having upper and lower sections, said drying grate comprising stationary grates alternating between reciprocating, movable grates, each of said grates having castings thereon, a transverse drive shaft attached on said drying grate, a bracket for each of said movable grates attached to said drive shaft, pivot means connecting said bracket with said movable grates on each of said upper and lower sections, and a shear pin in said bracket connecting said bracket to said drive shaft, whereby said movable grates are reciprocated between said stationary grates and said individual shear pins will break if one of said grates is prevented from movement thereby permitting the rest to move.

U.S. Pat. No. 3,383,071

Inventor: Roy E. Godson

Issued: May 14, 1968

A combination of a wire dispenser and a spool of wire, said combination comprising:

(a) a primary support and a secondary support;

(b) said primary support comprising two spaced apart first members;

(c) each first member comprising a first main arm;

(d) the first main arm on its upper end connecting with a support arm:

(e) said support arm on its upper end connecting with a crossarm;

(f) said crossarm being at substantially a right angle to the support arm;

(g) said crossarm connecting with a positioning arm;

(h) said positioning arm being at substantially a right angle to the crossarm and substantially parallel and spaced apart from the support arm;

(i) said first main arms diverging outwardly from the support arms;

(j) a plurality of cross braces connecting said first main arms;

(k) a plurality of upwardly inclined support lugs on the first main arms;

(l) said support lugs being in pairs with the lugs being aligned and at substantially the same elevation on the first main arms to position a support shaft;

(m) said secondary support comprising two spaced second main arms;

(n) a plurality of cross braces connecting said second main arms;

(o) said second main arms diverging outwardly from the upper part to the lower part;

(p) a plurality of upwardly inclined support lugs on the second main arms;

(q) said support lugs being in pairs with the lugs being aligned and at substantially the same elevation on the second main arms to position a support shaft;

(r) a shaft connecting the upper part of the second main arms and the first members;

(s) a base connector connecting the lower part of the second main arms and the first main arms to keep the lower part of the primary support and the secondary support from spreading too far apart;

(t) a support shaft positioned on two of the aligned support lugs and, (u) a spool of wire on said support shaft.

U.S. Pat. No. 3,610,431

Inventor: Horace E. Rodden

Issued: Oct. 5, 1971

A load-carrying rack for trailers and trucks consisting of a pair of spaced upright posts, each having thereon vertically spaced pairs of oppositely disposed support arms. Slidable sleeves on the upright posts, one located above each pair of support arms, have thereon clamping arms vertically aligned with the support arms. The slidable sleeves on each post are held in fixed spaced relationship by connector bars. A pivoted operator lever on each of the upright posts is connected by pivoted means to one of the slidable sleeves on the post. The slidable sleeves on each post are thus movable in unison so that the clamping arms thereon will simultaneously engage and disengage any load resting on the support arms.

U.S. Pat. No. 3,759,538

Inventor: Anthony J. Fabiano

Issued: Sep. 18, 1973

A mobile storage facility having means for safely and conveniently supporting a wide range of garden implements, accessories and supplies.

U.S. Pat. No. 3,870,177

Inventor: Willard J. Cobb

Issued: Mar. 11, 1975

The present invention relates to a mobile hand truck having a detachable load cradle movably thereon and operatively connected to a screw jack, The screw jack is disposed within the frame structure of the hand truck and is adapted to raise and lower the detachable load cradle relative to the frame structure of the hand truck.

U.S. Pat. No. 4,179,080

Inventor: Henry A. Patnaude

Issued: Dec. 18, 1979

Disclosed herein is an improved dolly for transporting tarpaulins or vinyl covers that are to be deployed or retracted over areas to be protected. The improvements consist of providing the cover deployment area with a protective shroud, an improved framework and suspension system, an improved steering arrangement, and a supplemental nesting area for tarpaulin supporting shafts that have been already deployed or are to be deployed.

U.S. Pat. No. 4,391,422

Inventor: Colin McDonald

Issued: Jul. 5, 1983

Four reels (R1, R2, R3, R4) of wire are supported for rotation about parallel support shafts (62, 64, 66, 68) which are spaced apart longitudinally of a main frame (12). The carrier (10) has a first dispense position (FIG. 6) in which a first end (1) of the main frame (12) makes contact with the ground and such main frame (12) slopes upwardly from such end to the second end of the main frame (12). When in its first dispense position the carrier (10) is supported by the first end (1) of the frame (12) and wheels (54, 56) carried at the lower end of a wheel support frame (16) which extends downwardly from an intermediate portion of the main frame (12). The carrier (10) has a second dispense position (FIG. 7) in which it is supported on and by the wheels (54, 56) and the lower end (2) of a support stand frame (14) which depends downwardly from the second end of the main frame (12). The main frame (12) slopes downwardly from its first end to its second end when it is in the second dispense position and the center of gravity CG of the loaded carrier (10) is located on the support stand side of the wheels (54, 56). The carrier (10) has a third or trundling position (FIG. 5) in which the center of gravity CG is substantially centered over the wheels (54, 56) and the loaded carrier (10) is substantially weight balanced on the wheels (54, 56).

U.S. Pat. No. 4,457,527

Inventor: A. J. Lowery

Issued: Jul. 3, 1984

A utility cart has features that allow it to be used over rough ground and stairways. The cart is a two wheel cart, with a base plate that projects forwardly for balancing the cart upright. The cart is rolled by tilting it rearwardly with handles. The cart has a back plate that is mounted across the frame and has a number of retainers for releasably retaining storage bins. Side plates are located on the sides of the base plate and back plate. The side plates have retainers for holding tools. Brackets on the insides of the side plates will receive a shaft for holding a spool of wire. The brackets will also receive a rung. The cart can then be used as a ladder. Braces extend rearwardly from the axle for facilitating moving the cart over stairways. A cover fits over the upper and front edges of the side plate to provide a secure enclosure. The cover can be moved to an open position where it will also serve as a temporary work table.

U.S. Pat. No. 4,496,028

Inventor: Theodore A. Peterson

Issued: Jan. 29, 1985

A sawhorse utilizing no nails or other fasteners comprising an elongate, generally circular member having a comparatively thick sidewall, but being otherwise hollow. The generally circular member is made of resilient material, having a spring-like quality, and the sidewall of the member is longitudinally cut for its entire length in a direction essentially parallel to the centerline of the generally circular member. Also, a pair of leg-receiving holes are cut through the generally circular member at a location substantially opposite from the longitudinal cut, with such holes being circumferentially spaced apart, and each being substantially equidistant from the ends of the circular member. Each of these holes is arranged to receive the upper end of an elongate leg member. Therefore, as the user draws the bottoms of the leg members together, the edges of the longitudinal cut are caused to move apart, so as to be able to receive the central beam of a sawhorse, and thereafter to tightly grasp such beam in a pincers-like grip when the leg members are released. Typically, two of the generally circular members are utilized for each sawhorse, with each member having associated therewith a pair of legs. The generally circular members may be made of PVC, such as of three inch inside diameter, and the longitudinal cut may be beveled in order to increase the power with which the central beam of the sawhorse is gripped by the edges of the cut.

U.S. Pat. No. 4,530,472

Inventor: Roy N. Voss, et al.

Issued: Jul. 23, 1985

This is a dispensing device or packet or container for dispensing tape for marking wire and is directed to a dispenser which will hold a large number of tape spools in a given volume and is easy to use and may be readily carried by the user. It has a cover with an open interior with a plurality of side openings with mountings and offset guides corresponding to the openings in the sides with the cover being hinged to a housing and a releasable latch therefor. It may be made in a two part housing with spools mounted in each half or a one part housing and a flat cover thereon. If it is made in a two part housing with spools in each half, there are openings in the side of the housing halves which are offset relative to each other.

U.S. Pat. No. 4,564,152

Inventor: A. A. Herriage

Issued: Jan. 14, 1986

A new and useful apparatus for storing and transporting reels of wire and dispensing the wire from the reels is provided. The reels are mounted on upwardly projecting spindles and retained there by their own weight, so that no removable parts are required to secure them to the cart. A guide is provided to restrict the lateral motion of the reel so as to prevent the wire from becoming tangled, to prevent pull on the wire from unseating the reel from the spindle and to align the wire with its intended objective such as a conduit. Additionally, a bar may be provided to frictionally contact the reel and retard its spinning after wire is withdrawn from the reel.

U.S. Pat. No. 4,752,047

Inventor: George J. Franks Jr.

Issued: Jun. 21, 1988

A collapsible cable or wire spool stand which, when erected, provides a stable platform about which a spool of cable or wire material can be supported to permit the withdrawal of cable or wire contained on the spool. The support structure may be readily collapsed from its erected configuration to minimize storage space. In a collapsed configuration, the horizontally disposed axle, upon which the spool is supported functions as a convenient handle to form a convenient handle for carrying the spool support stand.

U.S. Pat. No. 4,932,601

Inventor: J. W. Arrington

Issued: Jun. 12, 1990

A reel lift which includes a pair of cooperating lifting members, each characterized by a base constructed of angle iron and fitted with an upward-standing trunk which is also constructed of angle iron, which trunk divides the base into a foot portion and a heel portion of dissimilar size. A handle is welded or otherwise fixedly attached to the upward-standing trunk and a support sleeve is secured to the trunk in transverse relationship with respect to the handle and the base, in order to facilitate insertion of a support pipe for utilizing the reel lift members in concert to support a reel therebetween.

U.S. Pat. No. 5,692,701

Inventor: Larry R. Holliday

Issued: Dec. 2, 1997

Leg brackets for the reel holder have a bore between the side surfaces of its body portion. The bores are capable of receiving existing conduit which is combined with the leg brackets to form a holder for wire reels. The body portion has upwardly angled leg sockets extending in from each end and capable of receiving legs that support the body portion in a reel holding position. These legs can also be formed of existing conduit. A full width bottom slot is provided in the body portion which is combined with a cinching bolt at a lower portion of the body portion in the area of the slot. The cinching bolt when tightened being arranged to move the sides of the slot toward each other to bind the legs in their sockets. When the cinching bolt is released, the legs can be released from the body portion for disassembly of the holder.

U.S. Pat. No. 6,076,780

Inventor: Von Honnecke et al.

Issued: Jun. 20, 2000

A support stand for pipe, conduit, cable or the like which must be held above the surface of a roof. The stand is essentially triangular with the base of the stand forming one side and two legs, joined at their upper ends, forming the other two sides. A strap is fixed at one end to the face of one of the legs and extends upward, over the top of the stand and down the other side. There, it passes around the pipe, etc., to be supported, which rests against the face of the second leg, and then back over the top of the stand and downward past the first end. The free end passes through a tab bridge formed in, or attached to, the first leg. The height at which the pipe is supported is adjusted by altering the length of the free end which passes through the tab bridge. When the height is correct, the strap is folded back over the tab bridge to lock it in position. Preferably, the entire stand, including the strap, is made from sheet metal and the legs are of unequal length. Also preferably, the two legs are formed as a single piece which is shipped flat, and bent to form the two legs and attached to the base at the job site, using tabs inserted into tab bridges or slots, providing a knock down stand which can be assembled without tools.

U.S. Pat. No. 6,299,100

Inventor: Ken Cloud

Issued: Oct. 9, 2001

A cable reel lifter/transporter apparatus for elevating a heavy cable reel above a surface to permit free rotation of the reel, thereby allowing cable or tubing to be payed off the reel, and for manually transporting cable reels includes a pair of L-shaped planar frames each having a long straight handlebar arm and a relatively short straight leg which depends perpendicularly downwards from a lower surface of the handlebar, near a front transverse end thereof, each leg having at the lower end thereof a short tubular foot. A tubular bearing support protruding upwards from each handlebar rotatably supports opposite ends of a horizontal cable reel support shaft. A pair of arbors slidable on the shaft have inner tapered portions insertable into a separate spindle hole in each of two disk-shaped end plates of a cable reel, and subsequently secured to the shaft to hold the shaft and cable reel in a fixed position between the frames. Hand pressure exerted downwardly on the rear ends of the handlebars pivots the legs around the tubular axes of the feet, causing the cable reel support shaft and cable reel to elevate the reel end plates to a freely rotatable position above the ground. Rotating the handlebars on the cable reel support shaft in an opposite direction elevates the legs and feet above the ground, allowing the rear ends of the handlebars to be grasped to push the reel rollably along a surface, the cable reel end plates serving as wheels.

United Kingdom Patent Number GB827,826

Inventor: Standard Telefon Og Kabel-Fabric

Issued: Feb. 10, 1960

A pay—off and take—up stand for cable drums or reels comprising a lifting frame having bearings for the shaft carrying the cable drum or reel and pivotally mounted on a base frame at a point remote from said bearings, hydraulic lifting means acting along a substantially vertical path between the base frame and a point on the lifting frame close to the said bearing for raising the said drum clear of the base frame.

United Kingdom Patent Number GB966,726

Inventor: Lionel Osborne Clarke

Issued: Aug. 12, 1964

A portable flexible winding reel and stand with an outer reel so attached to the main reel that it holds the main reel together, the flexibility of the main reel being achieved by means of spring straps forming the sides of the reel, the flexibility of the stand lying in the arrangement of the support rising from the base to the reel.

While these spool supports may be suitable for the purposes for which they were designed, they would not be as suitable for the purposes of the present invention, as hereinafter described.

SUMMARY OF THE PRESENT INVENTION

This new bracket which to do the job at hand requires two brackets, is very portable. That is why an invention of this nature needs to be available to all trades that require a support bracket for a spindle that reels and/or spools are placed on. Another advantage of the new bracket is that the said spindle, with nothing but gravity pulling down on it, becomes bound by the spindle supports, limiting the ability of said spindle from rotating with the spools or reels and preventing a lateral movement of the said spindle. In so much that the said spindle(s) would not have to have exact dimensions, nor would it have to have, clips, pins, bores, or other devices or attachments, that might get lost or misplaced, rendering the prior art worthless or in effect, having to find something to haphazardly make it work for the time being, if a piece became lost or misplaced. This new bracket has no parts that need to be removed for any reason by the user to accomplish the task at hand, nor are any of the parts removable without other special tools.

As with this tool, all that is required to keep the said spindle in place is gravity, therefore, providing a very safe/efficient, inexpensive tool.

A primary object of the present invention is to provide a dispensing stand for wound material whereby inwardly angled support members hold a spool in suspension where said wound material can be dispensed therefrom.

Another object of the present invention is to provide a dispensing stand for wound material having angled apertures mad into a triangular support members apex corner for insertion there through of an axle to be suspended horizontally with inwardly angled supports at either end.

Yet another object of the present invention is to provide a dispensing stand for wound material that can easily be set up utilizing at least two support members to elevate a spool off the ground utilizing an axle.

Still yet another object of the present invention is to provide a dispensing stand for wound material having a collar around its angled receiving apertures to strengthen and better support an elevated spool.

Another object of the present invention is to provide a dispensing stand for wound material that can be easily be broken down into at least two support elements for storage and transport.

Yet another object of the present invention is to provide a dispensing stand for wound material having support members providing an AA@ frame type support to an elevated spool.

Additional objects of the present invention will appear as the description proceeds.

The present invention overcomes the shortcomings of the prior art by providing a stand used for supporting a reel of wound material typically wire, by means of an axle extending through a reel that is supported at either end by an axle support member having a triangular form and with at least one angled receiving aperture made through a corner having a collar, whereby when assembled produces a horizontally disposed axle supported by opposing inwardly angled triangular support members where said axle ends are supported about said support members apexes. Utilizing the present invention allows for easier distribution and a quick setup for dispensing wound products while providing a stand that is constructed in an arrangement whereby the reel is supported in a stable manner.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
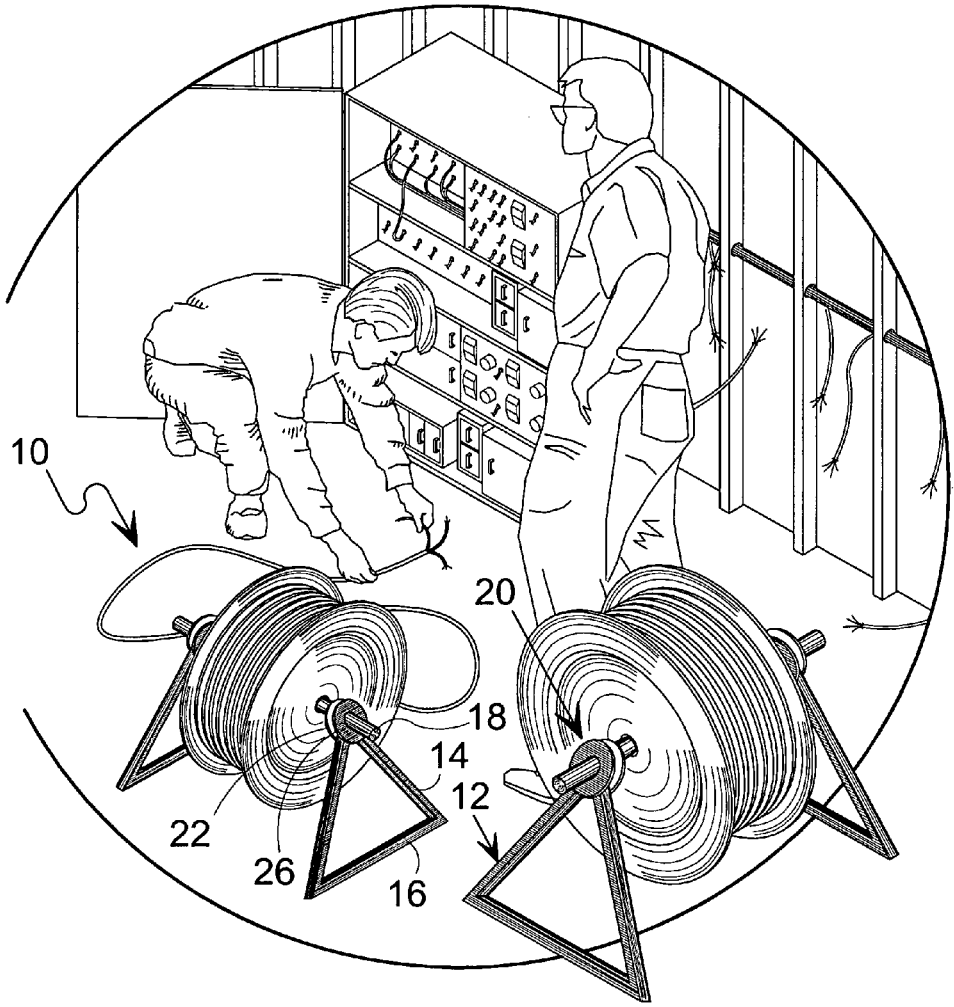
FIG. 1 is an illustrative view of the present invention in use.

Turning now descriptively to the drawings, in which similar reference characters denote similar elements throughout the several views, the Figures illustrate the portable search engine (POSE) of the present invention. With regard to the reference numerals used, the following numbering is used throughout the various drawing figures.

10 Spindle Support Bracket
12 spindle support bracket frame
14 leg of 14
16 base of 14
18 spindle
20 spindle supports
22 interior spindle support
24 interior spindle support aperture
26 exterior spindle support
28 exterior spindle support aperture
30 load
32 angular displacement
34 apertures vertical displacement
36 base span
38 load span

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative view of the present invention in use. Shown is the spindle support system 10 of the present invention in use to support a cable spool. The present invention comprises the use of at least two spindle support members 10 to suspend the spindle 18 by supporting each end thereof on opposing sides of the spool. The spindle support 10 is comprised of frame 12 comprising legs 14 and base 16 with spindle support 20 fixed thereto. Spindle support 20 has opposing support members 22 and 26 with apertures for receiving spindle 18.

Figure 2:
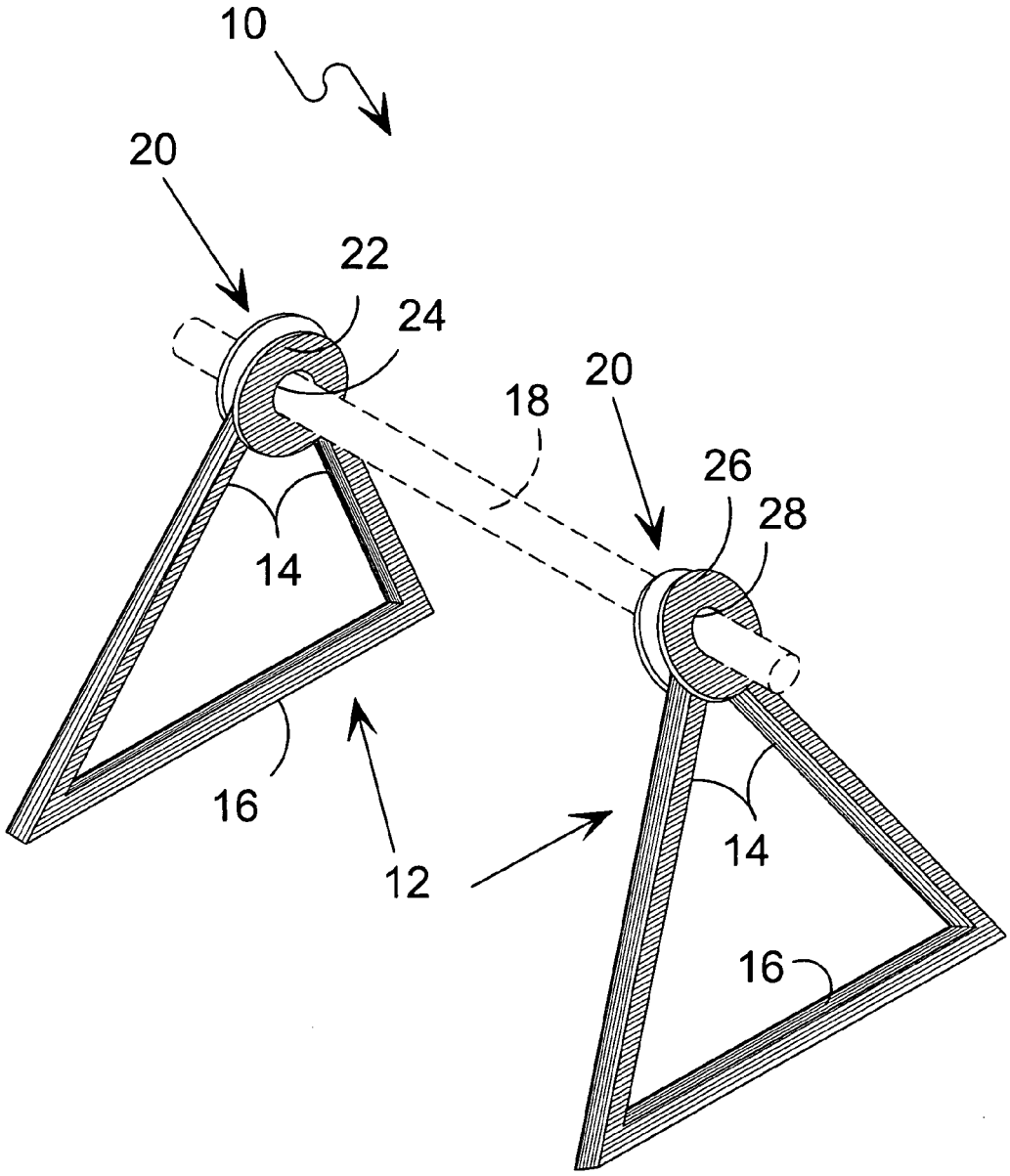
FIG. 2 is a perspective view of the present invention.

Referring to FIG. 2, shown is an illustrative view of the present invention. The spindle support bracket 10 is comprised of frame 12 have divergent legs 14 and conjoined base 16 with spindle supports 22, 26 having respective aperture 24, 28 for receiving spindle 18. By vertically displacing spindle support 22, 26, their respective spindle apertures cause frame 12 to angularly extend away from the load placed on spindle 18.

Figure 3:
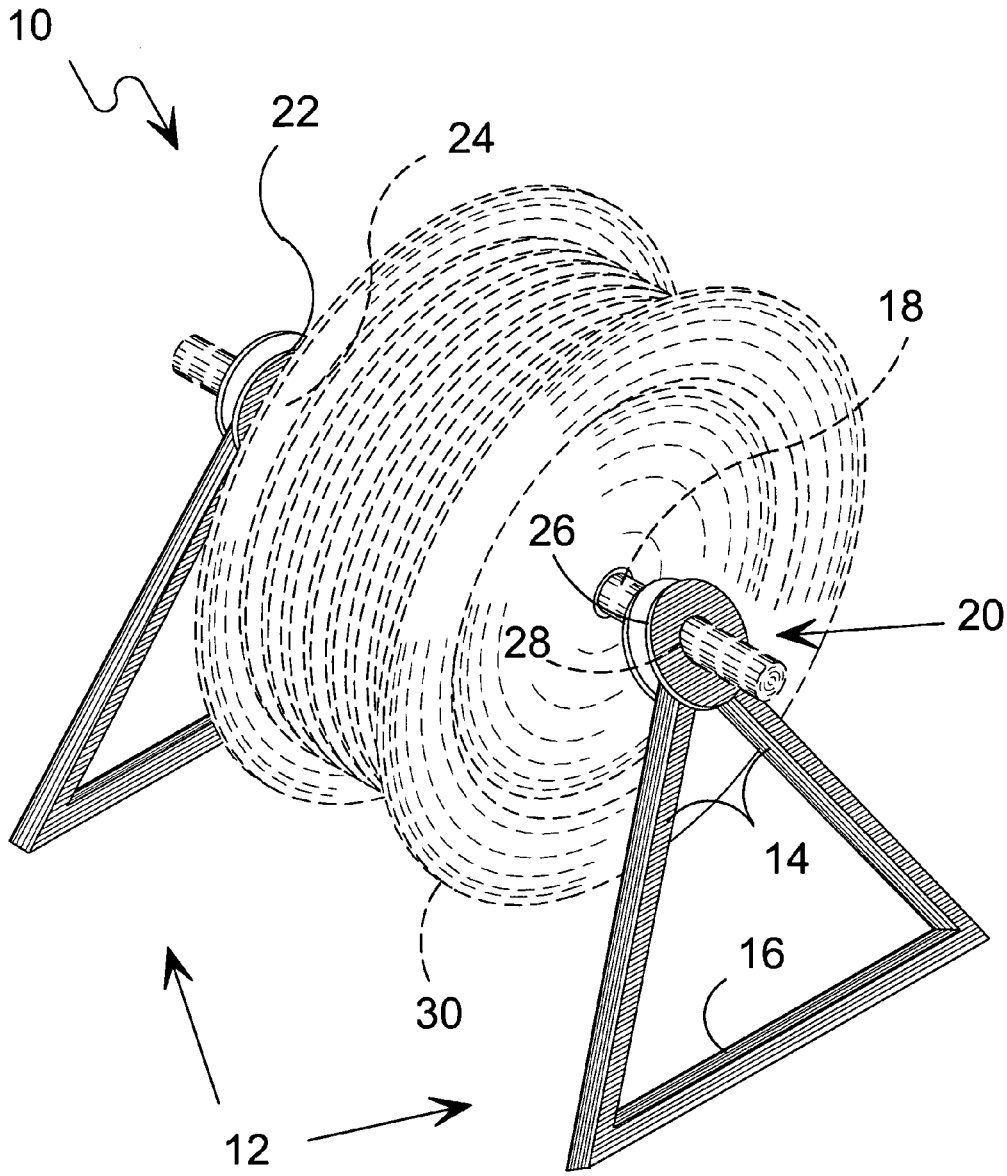
FIG. 3 is a perspective view of the present invention.

Referring to FIG. 3, shown is an illustrative view of the present invention in use. Illustrated is a pair of spindle support brackets 10 supporting a spool of wound material 30 mounted on spindle 18. Spindle support bracket 10 is comprised of frame 12 have divergent legs 14 and conjoined base 16 with spindle supports 20 fixed thereto comprising interior spindle support 22 and exterior spindle support, 26 having respective apertures 24, 28 for receiving spindle 18. By vertically displacing spindle support 22, 26, their respective spindle apertures 24, 28 cause frame 12 to angularly extend away from the load 30 placed on spindle 18.

Figure 4:
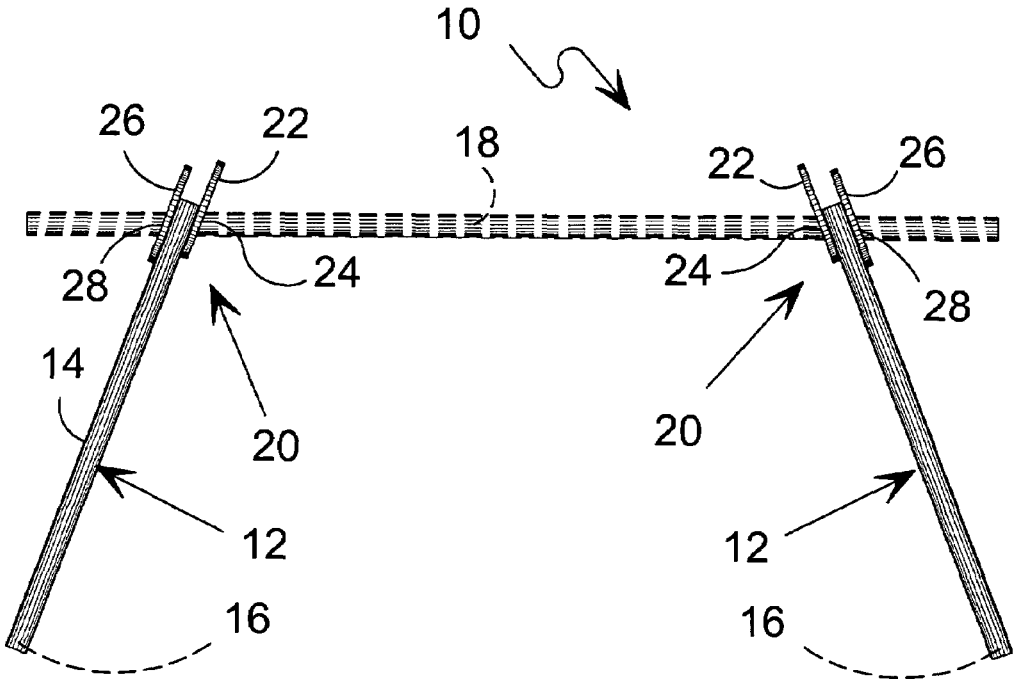
FIG. 4 is a frontal view of the present invention.

Referring to FIG. 4, shown is a frontal view of the present invention. Illustrated is a pair of spindle support brackets 10 having some form of spindle 18 supported thereby. Spindle support bracket 10 is comprised of frame 12 having legs 14 and base 16 with spindle supports 20 fastened thereto and forming an integral part therewith. Spindle support 20 has a pair of spindle supports spaced apart comprising interior spindle support 22 having interior spindle support aperture 24 and exterior spindle support, 26 having exterior spindle support aperture 28. By vertically displacing spindle support 22, 26, their respective spindle apertures 24, 28 cause frame 12 to angularly extend away from the load 30 placed on spindle 18. The structure provides support to elevate off the ground the spindle of a reel or spool of material so that the material may be easily unwound and held in location without assistance.

Figure 5:
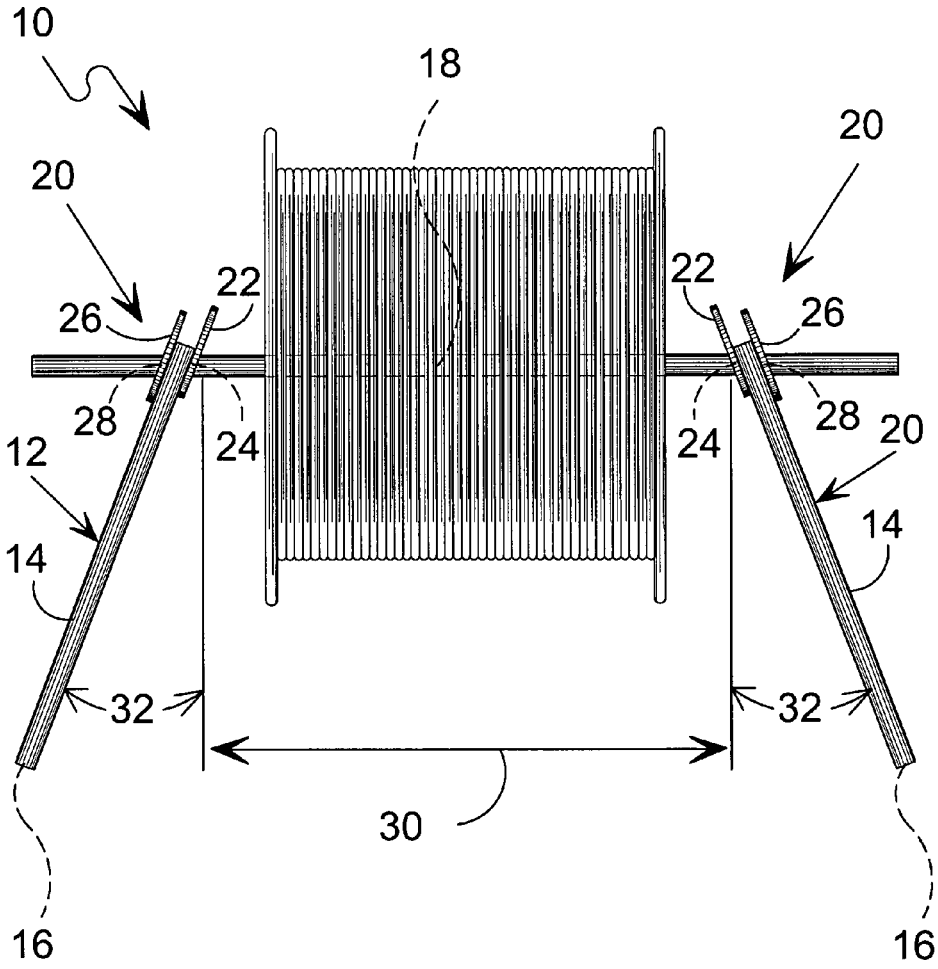
FIG. 5 is a frontal view of the present invention in use.

Referring to FIG. 5, shown is a frontal view of the present invention in use. Illustrated is a pair of spindle support brackets 10 having some form of spindle 18 supported thereby with a spool of wound material forming load 30. Spindle support bracket 10 is comprised of frame 12 having legs 14 and base 16 with spindle supports 20 fastened thereto and forming an integral part therewith. Spindle support 20 has a pair of spindle supports spaced apart comprising interior spindle support 22 having interior spindle support aperture 24 and exterior spindle support, 26 having exterior spindle support aperture 28. By vertically displacing spindle support 22, 26, their respective spindle apertures 24, 28 cause frame 12 to angularly extend 32 away from load 30 placed on spindle 18. The structure provides support to elevate off the ground the spindle of a reel or spool of material so that the material may be easily unwound and held in location without assistance.

Figure 6:
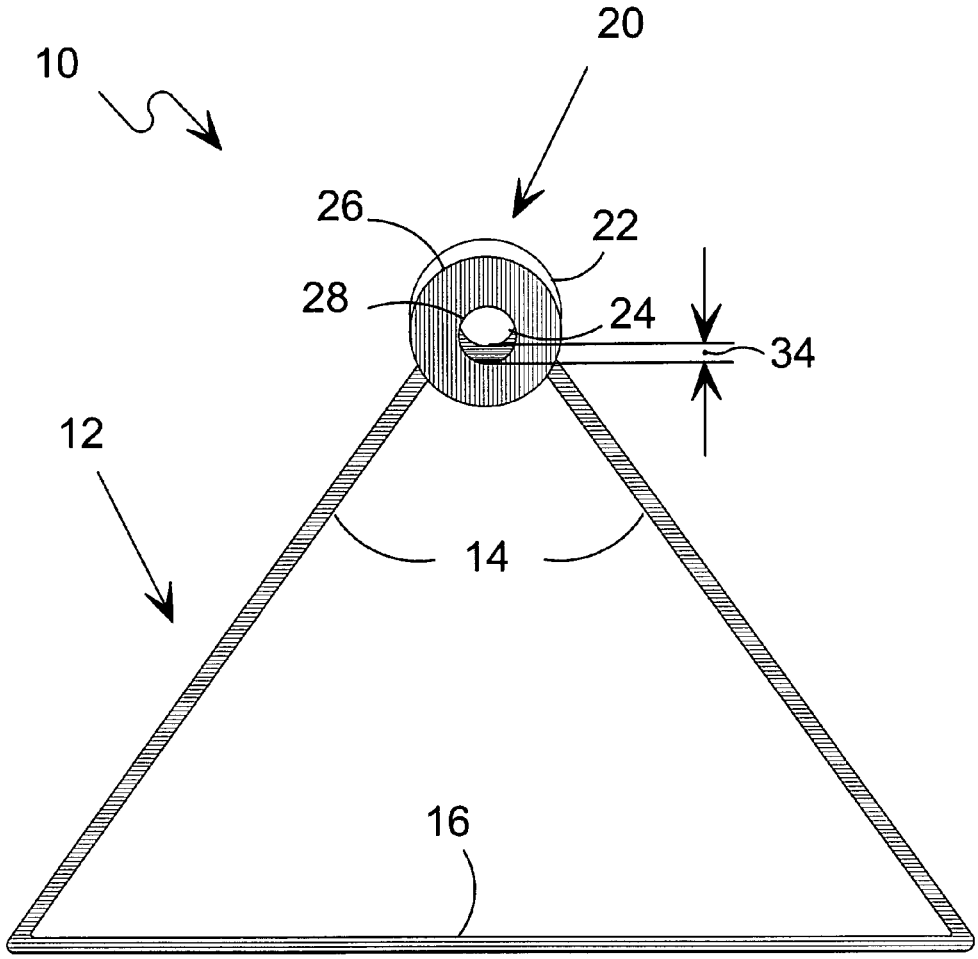
FIG. 6 is a side view of the present invention.

Referring to FIG. 6, shown is a side view of the present invention. Illustrated is the spindle support bracket 10 comprised of frame 12 having divergent legs 14 and conjoined base 16 with spindle supports 20 fastened thereto and forming an integral part therewith. Spindle support 20 has a pair of spindle supports spaced apart comprising interior spindle support 22 having interior spindle support aperture 24 and exterior spindle support, 26 having exterior spindle support aperture 28. By vertically displacing spindle support 22, 26, their respective spindle apertures 24, 28 create aperture vertical displacement 34, so that when a spindle is inserted therethrough frame 12 is angularly displaced away from the load placed on the spindle.

Figure 7:
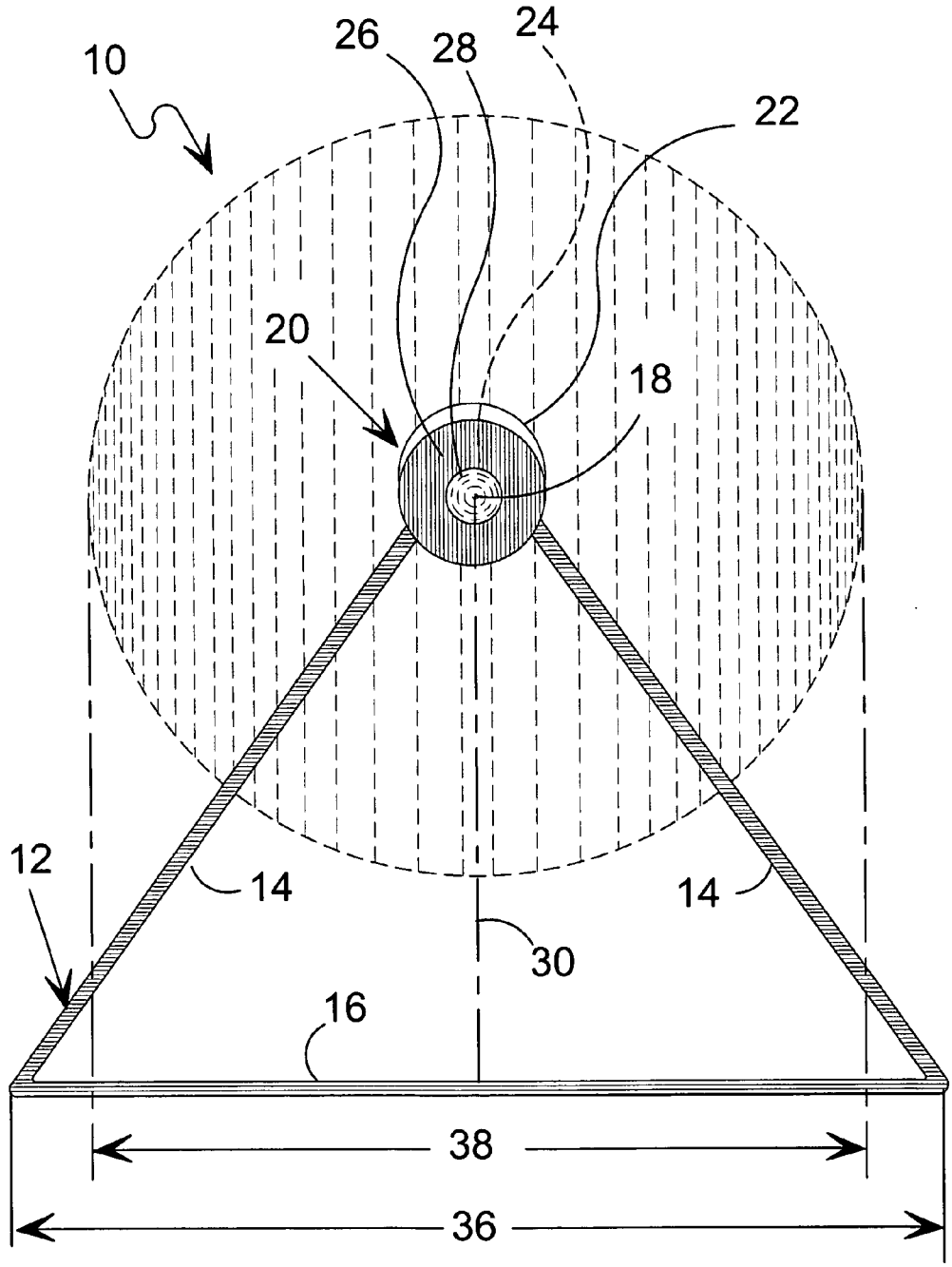
FIG. 7 is a side view of the present invention in use.

Referring to FIG. 7, shown is a side view of the present invention in use. Illustrated is the spindle support bracket 10 comprised of frame 12 having divergent legs 14 and conjoined base 16 with spindle supports 20 fastened thereto and forming an integral part therewith. Spindle support 20 has a pair of spindle supports spaced apart comprising interior spindle support 22 having interior spindle support aperture 24 and exterior spindle support, 26 having exterior spindle support aperture 28. By vertically displacing spindle support 22, 26, their respective spindle apertures 24, 28 creates aperture vertical displacement, so that when a spindle is inserted therethrough frame 12 is angularly displaced away from the load placed on the spindle. Furthermore, base 16 has a span 36 extending beyond load 30 center of gravity depending from spindle 18 that while not required by the present invention can exceed load span 38.

Figure 8:
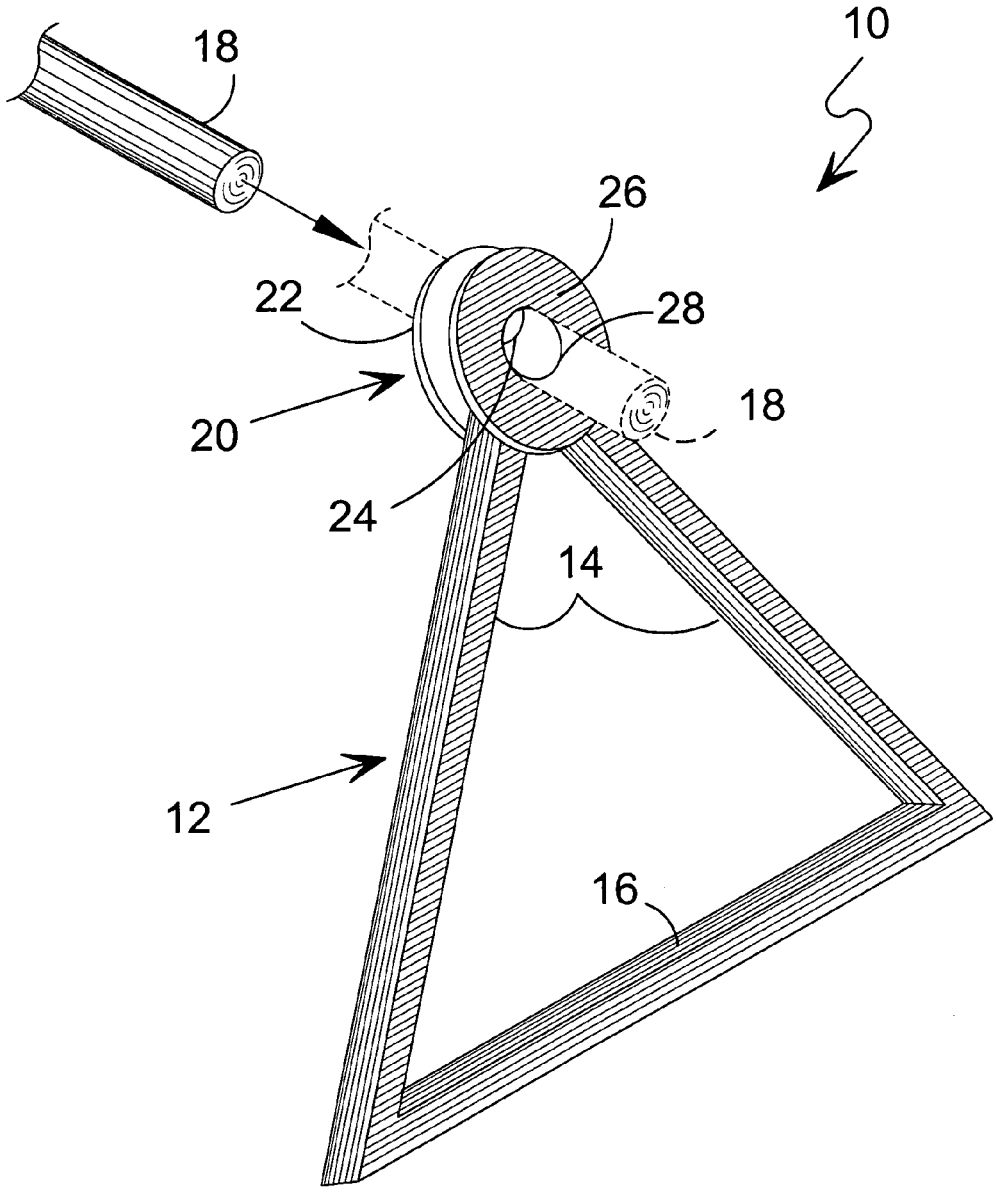
FIG. 8 is a detailed perspective view of the present invention.

Referring to FIG. 8, shown is an illustrative view of the present invention operatively positioned to receive a spindle. The spindle support bracket 10 is comprised of frame 12 have divergent legs 14 and conjoined base 16 with interior spindle support 22 having interior spindle support aperture 24 and exterior spindle support 26 having exterior spindle support aperture 28 vertically displaced causing frame 12 to angularly extend away from the load placed on spindle 18.

Figure 9:
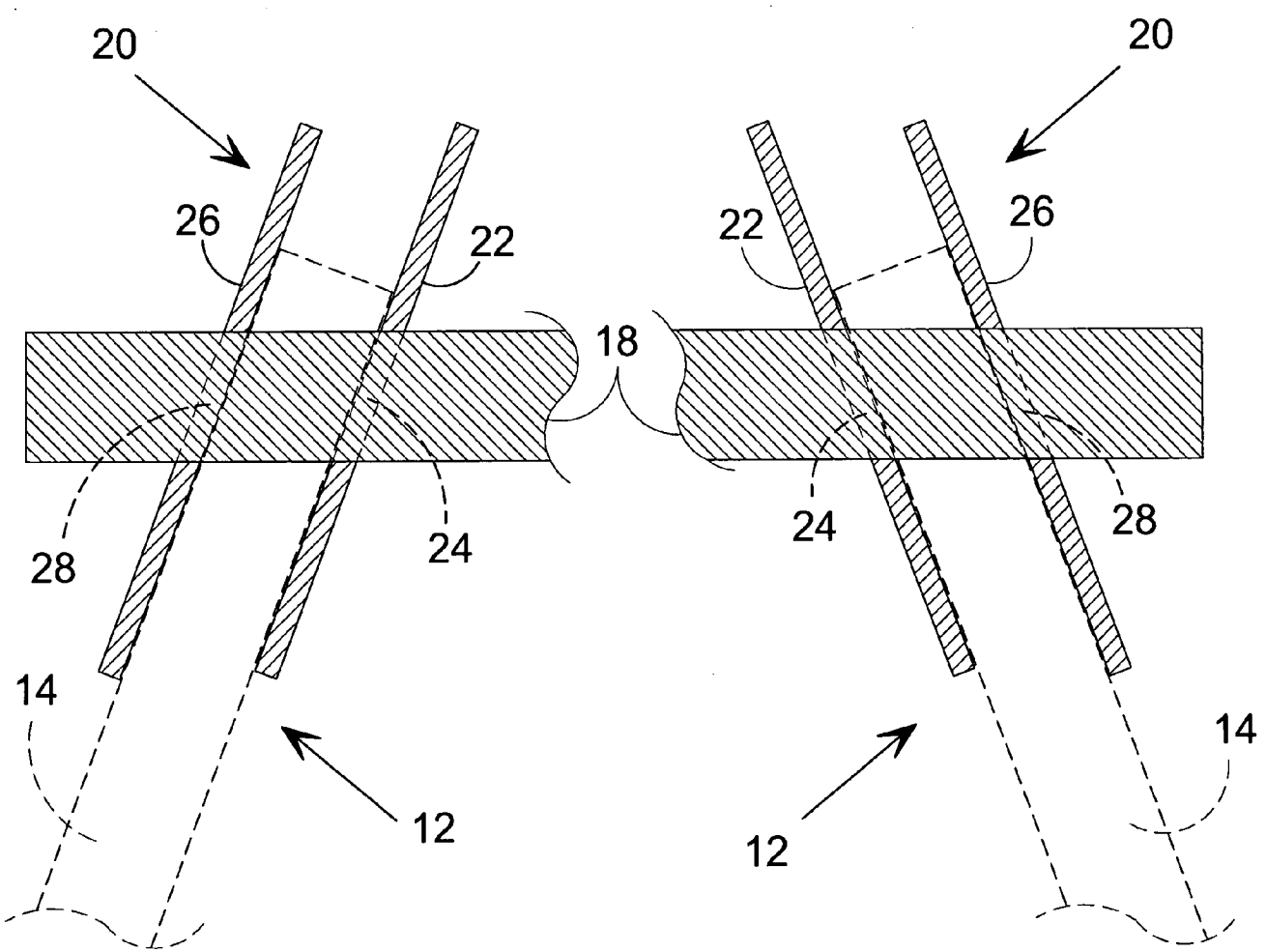
FIG. 9 is a detailed side view of the present invention.

Referring to FIG. 9, shown is a sectional view of the present invention in use. Once a spindle 18 is inserted through the spindle support apertures 24, 28, legs 14 of frame 12 divergently extend away from the load placed on spindle 18.

What is claimed is:

1. A spindle support bracket comprising:

a) a triangular frame;

b) spaced apart spindle support members fixed to the apex of the triangular frame and forming an integral part therewith; and c) apertures within the spindle support members that are relatively vertically displaced from each other.

2. The support bracket as recited in claim 1, wherein said triangular frame is comprised of a pair of divergent legs having a conjoined base extending therebetween.

3. The support bracket as recited in claim 1, wherein said triangular frame is comprised of a pair of divergent tubular legs having a conjoined tubular base extending therebetween.

4. The support bracket as recited in claim 1, wherein said triangular frame is alternately a solid structure.

5. The support bracket as recited in claim 1, wherein said spindle support members are comprised of separate members fastened to opposing sides of the triangular frame.

6. The support bracket as recited in claim 5, wherein said spindle support members each having an aperture passing therethrough.

7. The support bracket as recited in claim 6, wherein said apertures are vertically displaced from one to the other.

8. The support bracket as recited in claim 7, wherein said apertures are vertically displaced from one to the other so that an interior spindle support member is positioned higher than an exterior spindle support member causing the spindle support and integral triangular frame to be angularly displace away from the spindle load.

9. The support bracket as recited in claim 1, wherein said spindle support member is alternately a single housing fastened to the apex of the triangular frame.

10. The support bracket as recited in claim 9, wherein said spindle support member has an angularly displaced aperture passing therethrough.

11. The support bracket as recited in claim 10, wherein said apertures are vertically displaced from one to the other.

12. The support bracket as recited in claim 11, wherein said apertures are vertically displaced from one to the other so that an interior spindle support aperture is positioned higher than the other designated the exterior spindle support aperture causing the spindle support and integral triangular frame to be angularly extend away from the spindle load.

13. The support bracket as recited in claim 1, where a pair of support brackets can be used in conjunction to support opposing ends of a spindle having at least one spool of wound material mounted on said spindle and therefrom.

14. A spindle support bracket comprising a member shaped to form a triangle with two objects that have apertures that allow a spindle to pass through, securely attached to a vertex of the triangle, one on each side of the triangle offset vertically from each other that allows a spindle to pass through only if the assembly is tilted on an angle whereas the two apertures are aligned, keeping the spindle level and very stable and secure, with two brackets required to support a spindle.

15. The spindle support bracket as recited in claim 14, wherein said bracket has no parts that need to be removed or adjusted prior to use.

16. The spindle support bracket as recited in claim 14, wherein two brackets are capable of securely suspending a spindle in order to place spools or reels of material thereon for dispensing.

* * * * *